US006513779B2

(12) United States Patent
Halpin

(10) Patent No.: US 6,513,779 B2
(45) Date of Patent: Feb. 4, 2003

(54) BOOK HOLDING DEVICE

(76) Inventor: Patti Halpin, 2704 4th St., #2, Santa Monica, CA (US) 90405

( * ) Notice: Subject to any disclaimer, the term of this patent is extended or adjusted under 35 U.S.C. 154(b) by 0 days.

(21) Appl. No.: 09/898,981

(22) Filed: Jul. 2, 2001

(65) Prior Publication Data

US 2003/0001063 A1 Jan. 2, 2003

(51) Int. Cl.[7] ..... A47B 97/04
(52) U.S. Cl. ..... 248/451; 248/455; 248/441.1
(58) Field of Search ..... 248/451, 455, 248/441.1, 446, 453, 452

(56) References Cited

U.S. PATENT DOCUMENTS

| | | | | | |
|---|---|---|---|---|---|
| 352,654 | A | * | 11/1886 | Morton | 248/452 |
| 452,683 | A | * | 5/1891 | Walker | 248/451 |
| 1,923,351 | A | * | 8/1933 | Woodley | 248/451 |
| 2,003,746 | A | * | 6/1935 | Headington | 248/451 |
| D168,420 | S | * | 12/1952 | Pinkham, Jr. | D33/2 |
| 3,041,774 | A | * | 7/1962 | Walker | 248/451 |
| 3,200,791 | A | * | 8/1965 | Swett | 248/452 |
| 3,351,312 | A | * | 11/1967 | Ballas | 248/451 |
| 3,718,308 | A | * | 2/1973 | Hainault | 248/460 |
| 3,951,374 | A | * | 4/1976 | Quigley | 248/451 |
| 4,014,508 | A | | 3/1977 | Weiss | |
| 4,150,807 | A | * | 4/1979 | Manso | 248/452 |
| 4,508,307 | A | | 4/1985 | Morales | |
| 4,512,603 | A | * | 4/1985 | Williams | 294/137 |
| 4,712,760 | A | * | 12/1987 | Winter | 248/451 |
| 5,165,648 | A | * | 11/1992 | Quigley | 248/451 |
| 5,165,722 | A | | 11/1992 | Wong | |
| 5,246,251 | A | | 9/1993 | Evans | |
| 5,263,865 | A | * | 11/1993 | Zipf | 434/309 |
| D362,565 | S | * | 9/1995 | Tubbs et al. | D6/419 |
| 5,582,382 | A | | 12/1996 | Pan-Yang | |
| 5,829,787 | A | | 11/1998 | Newhouse, Jr. | |
| 5,855,329 | A | * | 1/1999 | Pagano | 248/451 |
| 6,019,339 | A | | 2/2000 | Brayford | |
| 6,045,107 | A | | 4/2000 | Carlson | |
| 6,045,159 | A | | 4/2000 | Bellah | |
| 6,220,559 | B1 | | 4/2001 | Chow | |

FOREIGN PATENT DOCUMENTS

| | | | | |
|---|---|---|---|---|
| FR | 729468 | * | 4/1932 | 248/451 |
| FR | 2602130 A1 | * | 2/1988 | A47B/23/04 |

* cited by examiner

*Primary Examiner*—Kimberly Wood
(74) *Attorney, Agent, or Firm*—Robert M. Sperry

(57) ABSTRACT

A book-holding device constructed from a block of semi-rigid foam, including a cut-out which forms a frontal ledge. A wire runs horizontally through a back section of the foam structure, extending outwardly from both sides in an arm-like fashion. When an open book is placed upon the frontal ledge, the wires bend or adjust forwardly to hold the book in place upon the foam structure. Importantly, the wire may be coated with vinyl or the like to prevent damage to the pages, and to allow the pages to turn with ease. Thus, the present invention allows for hands-free reading in an effective and convenient manner. Such is particularly helpful to persons with an impaired arm or wrist. In addition, the present invention is effective for persons who are utilizing their hands for other applications, such as cooking or typing. Finally, the present invention may also be used to display an open book for the purposes of decoration or design.

1 Claim, 2 Drawing Sheets

BOOK HOLDING DEVICE

BACKGROUND OF THE INVENTION

1. Field of the Invention

The present invention is a book-holding device. In the preferred mode, the body of the book-holder is constructed from a block of semi-rigid foam, including a cut-out which forms a frontal ledge. A wire runs horizontally through a back section of the foam structure, extending outwardly from both sides in an arm-like fashion. When an open book is placed upon the frontal ledge, the wires bend or adjust forwardly to hold the book in place upon the foam structure. Importantly, the wire may be coated with vinyl or the like to prevent damage to the pages, and to allow the pages to turn with ease.

2. Description of the Prior Art

Numerous innovations for book-holding devices have been provided in the prior art that are described as follows. Even though these innovations may be suitable for the specific individual purposes to which they address, they differ from the present invention as hereinafter contrasted. The following is a summary of those prior art patents most relevant to the invention at hand, as well a description outlining the differences between the features of the present invention and those of the prior art.

1. U.S. Pat. No. 6,019,339, invented by Brayford, entitled "Book Holder"

The patent to Brayford describes a flexible resilient book holder which permits an open book to be placed between a first and second planar surface keeping the pages on each side of the book in a relatively flat plane to permit the reader to read both pages.

2. U.S. Pat. No. 5,829,787, invented by Newhouse, Jr., entitled "Book Holder"

In the patent to Newhouse, Jr., a book is held on a support having a spring clip on the side. The clip is designed to hold a transparent arm extending across the open book. Depressing the clip lifts the arm, allowing a page to be turned.

3. U.S. Pat. No. 6,045,159, invented by Bellah, entitled "Book Holder"

The patent to Bellah describes a holder for a book, such as a paperback or hard cover book, comprising a stiff flat member creased to provide a central stationary panel corresponding to the spine of the book, and a pair of pivoted panels corresponding to the front and back of the book. A spring assembly comprises a plurality of long concave thin metal members connected together by a strip of tape and connected to the stiff flat member by a pop rivet. The ends of the springs are received by a pair of plastic sleeves which are stitched to the stiff flat member. The stiff flat member is covered by a vinyl sheet in such a way as to have a curved edge providing a radius of at least 1/16". A transparent strap connects to the opposite sides of the book holder and presses open pages of the book against the flat stiff member. The curved edge prevents the transparent strap from being cut by the book holder.

4. U.S. Pat. No. 4,014,508, invented by Weiss, entitled "Book Holding Device"

The patent to Weiss describes a book holding device comprising a pair of rigid elongated page-retaining members secured to a book-supporting board by a pair of elastic cords which extend across the back of the board. Means are provided for restricting the horizontal movement of the cords beyond predetermined limits.

5. U.S. Pat. No. 5,246,251, invented by Evans, entitled "Book Holder"

The patent to Evens describes a book holder in the form of an elongate panel composed of a light, durable material, such as plastic, including a base portion and a U-shaped end at each of the opposite sides thereof. The U-shaped ends are dimensioned so as to provide an overhang for trapping the pages of a book between the overhang and the respective adjacent base portion. In a variation of the foregoing, an extensible book holder is disclosed in which the base portion now has a right base component and a left base component which are joined so as to permit a selectively extensible interaction therebetween for accommodating books of various widths with a single book holder. In operation, the user engages an open book with the book holder so that a portion of opposing sides of the book (that is, the left and right side of the book located at opposite sides of its spine) are captured by the U-shaped ends and the base portion. The U-shaped ends are dimensioned so that they do not pose a problem with comfortable reading of the pages; indeed the plastic may be clear or otherwise see-through. When it is time to turn pages, a simple finger movement is all that is necessary to remove the page being turned from the overhang on the right and to trap it under the overhang on the left (and vice versa). Paralyzed persons and persons with arthritis or other disabilities can easily turn book pages using the book holder, needing only a pencil-like tool held in their mouth.

6. U.S. Pat. No. 6,045,107, invented by Carlson, entitled "Holder For Reading Material"

The patent to Carlson describes a holder for reading material while reclined such that the holder is light, portable, and easy to use. The holder allows for easy turning of pages and sufficient support for the reading material. The holder for reading material comprises a pair of horizontal base footings which are attached to a pair of vertical legs. The pair of vertical legs are attached to a pair of horizontal arms which support the reading material. A v-shaped piece is attached to the horizontal arms. The v-shaped piece assists in supporting the reading material. A pair of page clips are attached to the pair of horizontal arms. The pair of page clips clasp the pages of the book, thus, holding the book open to the page currently being read by the reader.

7. U.S. Pat. No. 5,582,382, invented by Pan-Yang, entitled "Folding Book Stand"

The patent to Pan-Yang describes a folding book stand including a base plate having a pivot at the front side, a back plate pivotably connected to the pivot by a first connecting arm and supported in any of a series of tilted positions by a back stand, and a book holder pivotably connected to the pivot by a second connecting arm ad supported in a tilted position perpendicular to the first connecting arm, wherein the base plate defines a flat bottom chamber for receiving the back plate, the back stand and the book holder when the book stand is folded up.

8. U.S. Pat. No. 6,220,559, invented by Chow, entitled "Reading Assistive Device For Individuals"

The patent to Chow describes a reading assistive device that suspends reading material above a reclining or supine user. Reading assistive device communicates with the reading material using wing folds of page support. The reading material is fit through a central window of page support and the pages rest upon left wing fold and right wing fold. Wing folds have slots that enable a the user directly, or with the mouthstick, to interact with the reading material pages. The reading material is secured between a rigid rod and an elastic cord that comprises part of a securing subassembly. An interlocking endcap and an interlocking endcap enable securing subassembly to operably interact with page support. Page support is supported by an articulated swing arm subassembly, which enables reading assistive device to suspend reading material above a reclining or supine user from their bed or chair.

9. U.S. Pat. No. 5,165,722, invented by Wong, entitled "Book Leaf Holder"

In the patent to Wong, a book leaf holder maintains a book in an opened position with the pages held firmly down. In a preferred form the holder comprises a single piece of wire having a curving back portion and bends at each end forming arms which extend over the opened pages and a clip-like end which maintains the arms in position. The wire device acts somewhat in the manner of a large paper clip, having an undeformed position which is essentially planar and tending to return to the planar condition when in use, tending to urge the book toward being flat. The center curving section of the device bears against the center binding behind the opened book, and in the usual manner of use the arm on each side clips over and holds down an opened page. The end finger or clip beyond the arm is inserted under a sheaf of pages, e.g. 30 or 50 pages below the opened page. The book holder clip stores flatly and is useful as a bookmark when the book is closed. Other embodiments, formed of other materials and of multiple components, are disclosed.

10. U.S. Pat. No. 4,508,307, invented by Morales, entitled "Foldable, Self-Supporting, Adjustable Book Holder"

In the patent to Morales, a foldable, self-supporting, adjustable book holder is disclosed having a first base member formed of an elongated base section having a planar portion which deflects at a bend into an elevated, substantially parallel elongated member wherein the elevated, elongated support member has an elongated slot formed therein which is adapted to receive an elevated boss positioned within and movable within the elongated slot, a second base member having an elongated, substantially planar support member having an elevated boss member formed at one end thereof which is adapted to be positioned into and slidable within the elongated slot, a pair of side members which are adapted to be pivotally connected to the ends of the first base member and the second base member such that the elevated boss is positioned in and is movable with the elongated slot to form a book support when in upright position and wherein the opposite ends of the side members have a plurality of axially aligned openings formed therein to receive an elongated adjustable rod member and an elongated holding and support member having a protruding lip formed at the other end thereof to form a three-point loading system to support a book. The foldable, self-supporting, adjustable book holder is adapted to be formed into a folded, compact book holder.

The aforementioned prior art patents illustrate various designs intended to provide for hands-free reading. For the purposes of example, the patents to Bellah and Weiss illustrate book holders comprising a back surface on which to rest the open book, and at least one front support member to hold the book open to a particular page. However, these designs fail to teach the usage of a soft, lightweight support structure, and further fail to teach the usage of arm members with a vinyl tubing to facilitate turning of the pages.

Other relevant prior art designs include: clip-board like book holder designs; book holders featuring illumination means; book holders featuring cup holders and other ancillary items; suspended book holding structures for handicapped persons; and book holders constructed of substantially rigid or heavy materials.

In contrast to the above, the present invention is constructed of foam, with a wire running through a back section extending from both sides to form arms. The pliable quality of the structure allows for books of a variety of sizes and thickness to fit within the book holder. Furthermore, the foam construction of the invention allows for low manufacturing costs, ease of production and shipping, and lighter overall weight of the product.

Finally, unlike the prior art, the support wire is coated with a vinyl tubing or the like to prevent damage to the pages and allow the pages to turn easily. In total, the present invention allows for hands-free reading in a more effective and more convenient manner than shown in the prior art devices.

SUMMARY OF THE INVENTION

As noted, the present invention is a book-holding device. In the preferred mode, the body of the book-holder is constructed from a block of a semi-rigid material such as foam, including a cut-out which forms a lip or frontal ledge. A wire runs horizontally through a back section of the housing structure, extending outwardly from both sides in an arm-like fashion. When an open book or other reading material is placed upon the frontal ledge, the wires bend or adjust forwardly to hold the book in place upon the foam structure. Importantly, the wire may be coated with a vinyl tubing or the like to prevent damage to the pages and to allow the pages to turn with ease.

Thus, the present invention allows for hands-free reading for a variety of persons in an effective and convenient manner. Such is particularly helpful to persons with an impaired arm or wrist, such as due to the common carpal tunnel syndrome and other repetitive motion related ailments. In addition, the present invention is effective for persons who are utilizing their hands for unrelated applications, such as cooking or typing. Finally, the present invention may also be used to display an open book for the purposes of decoration or design.

In light of the foregoing, it is generally an object of the present invention to provide a device that allows one to read a variety of materials in a hands-free manner.

It is a further object of the invention to provide a comfortable and convenient means for those with carpal tunnel syndrome and adverse effects of repetitive motion activities to read for long periods of time without pain and discomfort.

It is a further object of the invention to provide a comfortable and convenient means for those with any of a number of other physical disabilities to read for long periods of time.

It is a further object of the present invention to provide a device that is relatively inexpensive to manufacture, produce, and distribute.

It is a further object of the present invention to provide a device that may be manufactured in a variety of shapes and sizes.

In addition, it is an object of the present invention to provide a device that is lightweight in nature and easy for a user to transport to beaches, parks, or on a variety of trips.

It is an object of the present invention to provide a device that may include text or graphics thereon, for the purposes of advertisement, education, or amusement and entertainment.

It is also an object of the present invention to provide a device that may a hold a variety of sizes of books, magazines, and other reading materials, for the utmost in versatility.

Finally, it is an object of the present invention to provide alternate embodiments of the device, wherein the invention is constructed of different materials, according to manufacturer and user needs.

The novel features which are considered characteristic for the invention are set forth in the claims. The invention itself, both as to its construction and its method of operation, together with additional objects and advantages thereof, will be best understood from the following description of the embodiments when read and understood in connection with accompanying drawings.

BRIEF DESCRIPTION OF PREFERRED EMBODIMENTS

DETAILED DESCRIPTION OF THE PREFERRED EMBODIMENT

Figure 1:
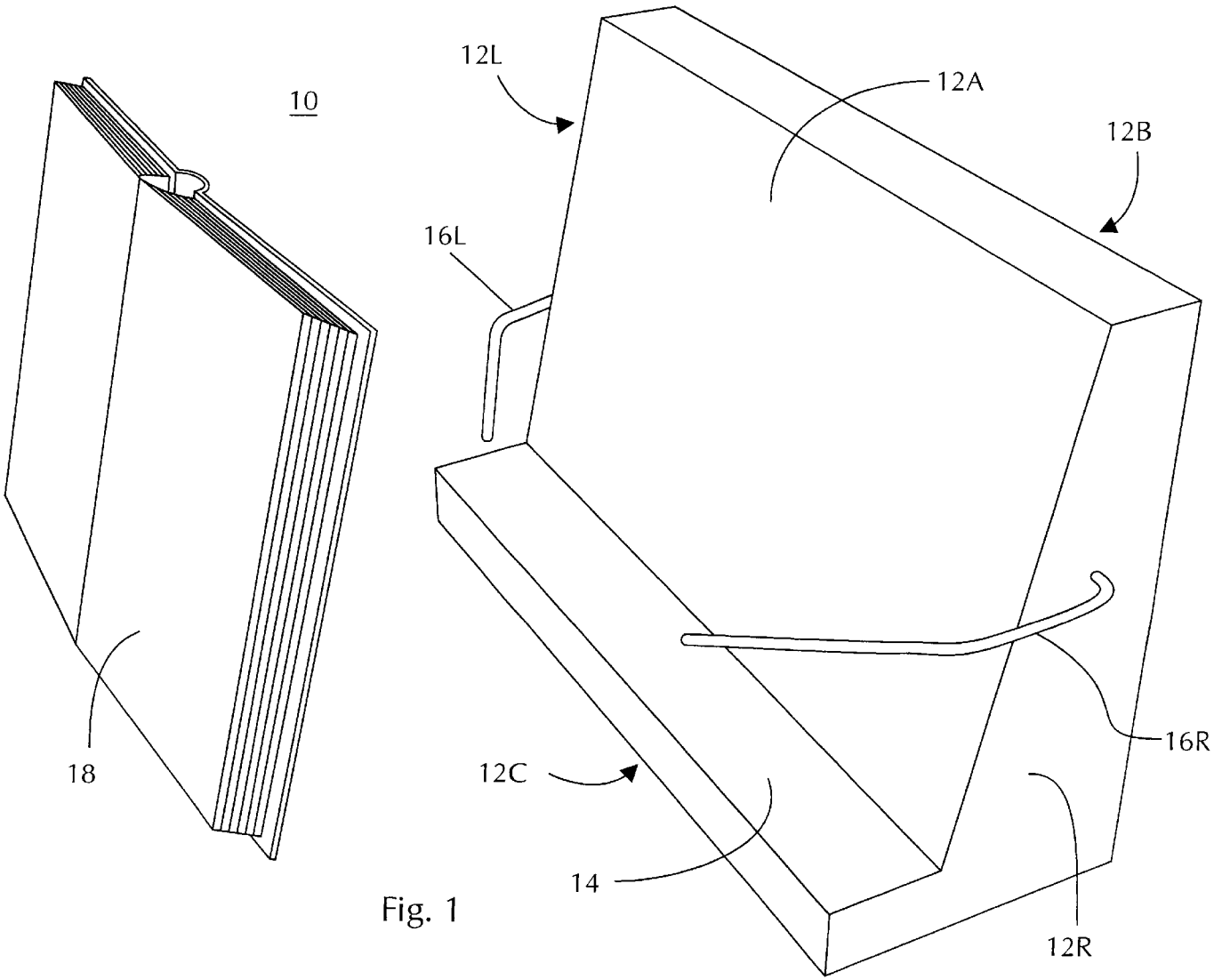
FIG. 1 is a front, three-quarter perspective view of the present invention, illustrating the holder and intended location of reading materials to be placed thereon.
Figure 2:
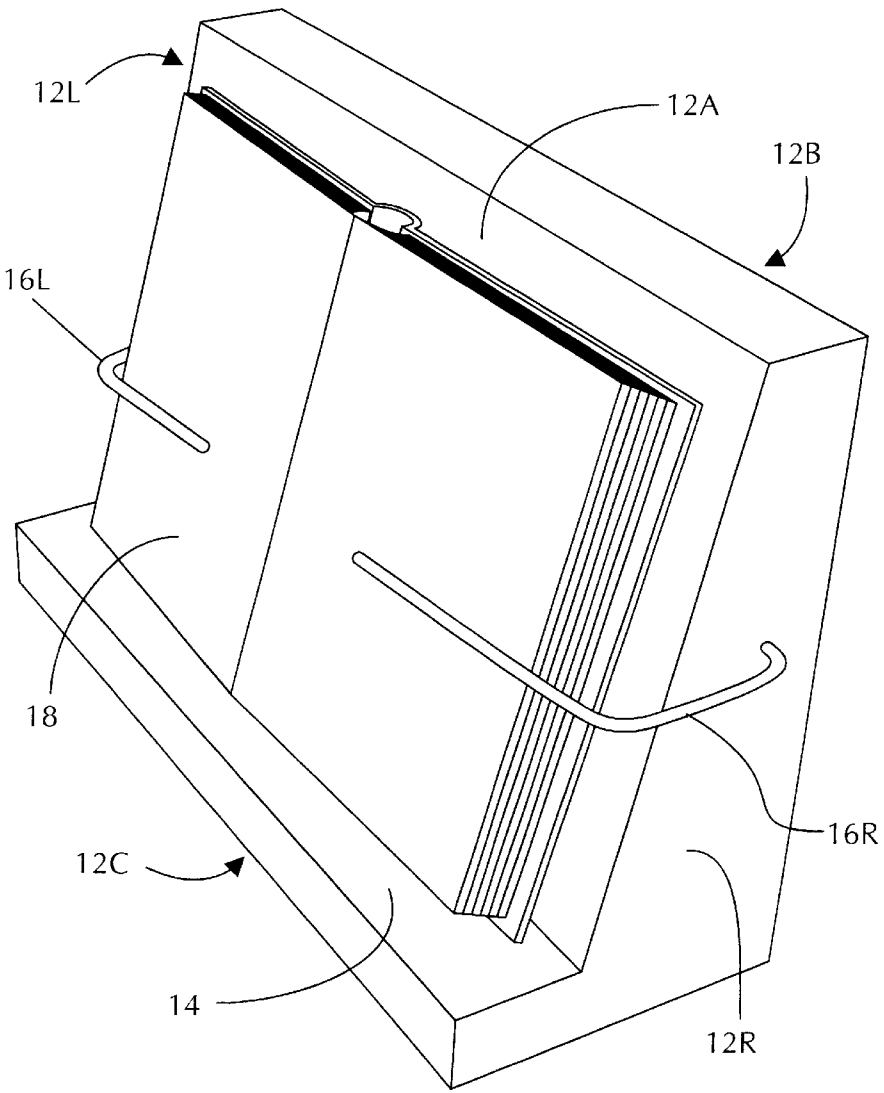
FIG. 2 is a front, three-quarter perspective view of the present invention, illustrating the holder with reading materials placed thereon, and held by left and right wire members.

Referring to FIG. 1, which is a front, three-quarter perspective view of the present invention, illustrating the holder without reading materials placed thereon, and FIG. 2, which is a front, three-quarter perspective view of the present invention, illustrating the holder with reading materials placed thereon:

The drawings depict the book holding device (10), housing front surface (12A), housing back surface (12B), location of housing bottom (12C), housing left side (12L), housing right side (12R), front lip (14), wire left portion (16L), wire right portion (16R), and open book (18).

More particularly, the book holding device (10) comprises a generally lightweight, pliable housing which comprises a generally flat bottom (12C), raised back portion (12B), left side (12L), and right side (12R). The raised back portion (12B) of the housing is angled away from a user at a previously-determined degree, functioning to provide a front facing angled surface. For example, the device may function to hold an open book at an angle of forty-five to ninety degrees, as desired by the manufacturer or user.

The housing further comprises a generally flat lip surface (14) that is parallel to the bottom surface (12C). The lip surface (14) is located at the front of the housing and extends forwardly therefrom, functioning to allow a bottom edge of an open book (18) to rest upon the lip (14) and back of an open book to rest upon the angled surface or back portion (12B). The lip (14) of the device may of a depth of a range of one to four inches, so as to render the same available to hold books of a great variety of sizes and quantity of pages.

Next, the housing further comprises at least one wire member (16L) extending outwardly from a left side of the housing (12L). The wire (16L) is bent at a previously determined angle, bent generally in a "U" shape, and functions to hold a left side of an open book (18) in place against the angled surface (12B).

Likewise, the housing further comprises at least one wire member (16R) extending outwardly from a right side (12R) of the housing. The wire (16R) is bent at a previously determined angle, also bent generally in a "U" shape, and also functions to hold a right side of an open book (18) in place against the angled surface (12B).

The left and right wires (16L, 16R) are coated with tubing material which functions to provide a generally slick surface. This allows pages of the open book (18) held by the wires to turn easily, such that the book holding device functions to allow users to effectively read the open book in a hands-free manner.

In the preferred modes of production, the device is of a width in the range of six to eighteen inches. In addition, the device is of a depth in the range of four to twelve inches and a height in the range of six to twelve inches.

The wire (16L, 16R) may manufactured of a material selected from the group consisting of metal, plastic, and polymers, as such are durable, lightweight, and generally inexpensive for manufacture. Moreover, the wire coating material utilized may be a vinyl tubing to create a smooth outer surface. Any such wires may be of a length of four to twelve inches, for the purposes of example.

In addition, the pliable material from which the housing is constructed functions to allow a user to partially depress a book therein for secure placement. Alternatively, the housing may be constructed of a styrofoam material, which further reduces manufacturing costs and reduces weight of the item.

In enhanced embodiments of the present invention, the device bears indicia, text, and graphics thereon, to create an aesthetically pleasing item that is also functional in nature.

In addition, in other enhanced modes of manufacture, the device further comprises at least one pocket which functions to hold that relate to reading and writing, such as bookmarks, pens, pencils, reading glasses or the like.

Moreover, the device may comprise additional support members for upright stability, particularly for the containment of larger or heavier books.

In addition, the device may further comprise an illumination means located upon the housing, which functions to assist the user in reading in night-time applications.

Furthermore, because the present invention may keep books and literary materials in a fixed open position, the device may used as a unique display item for residential or commercial applications.

It should also be noted that the device allows the user to turn pages through usage of a pencil eraser end. This allows for additional user convenience, and is particularly helpful for those with disabilities or those who suffer from repetitive motion-related conditions.

Therefore, in total, the present invention allows for hands-free reading in an effective and convenient manner rendering the same particularly helpful to persons with an impaired arm or wrist. In addition, the present invention is effective for persons who are utilizing their hands for other applications, such as cooking or typing. Finally, the present invention may also be used to display an open book for the purposes of decoration or design.

With regards to all descriptions and graphics, while the invention has been illustrated and described as embodied, it is not intended to be limited to the details shown, since it will be understood that various omissions, modifications, substitutions and changes in the forms and details of the device illustrated and in its operation can be made by those skilled in the art without departing in any way from the spirit of the invention.

Without further analysis, the foregoing will so fully reveal the gist of the present invention that others can readily adapt it for various applications without omitting features that, from the standpoint of prior art, constitute essential characteristics of the generic or specific aspects of this invention. What is claimed as new and desired to be protected by Letters Patent is set forth in the appended claims.

What is claimed is:

1. A book holding device comprising:

a housing is a solid formed of pliable foam material of generally trapezoidal shape having parallel upper and lower surfaces, a front surface inclining forwardly from top to bottom and a rear surface with a ledge projecting forwardly from the bottom of said front surface, and an arm of generally a U-shape mounted in said housing and open at the front to overlie said ledge.

* * * * *